United States Patent [19]

Gazda

[11] Patent Number: 4,750,560

[45] Date of Patent: Jun. 14, 1988

[54] DEVICE FOR RELEASABLY CONNECTING WELL TOOLS

[75] Inventor: Imre I. Gazda, Fort Worth, Tex.

[73] Assignee: Otis Engineering Corporation, Dallas, Tex.

[21] Appl. No.: 37,811

[22] Filed: Apr. 13, 1987

[51] Int. Cl.[4] ..... E21B 23/00

[52] U.S. Cl. ..... 166/240; 166/382

[58] Field of Search ..... 166/237, 240, 242, 243, 166/380, 382; 285/360; 403/321, 322

[56] References Cited

U.S. PATENT DOCUMENTS

| | | | |
|---|---|---|---|
| 2,698,056 | 12/1954 | Marshall et al. | 166/123 |
| 2,884,071 | 4/1959 | Fredd | 166/137 |
| 3,100,533 | 8/1963 | Fredd | 166/125 |
| 3,102,593 | 9/1963 | Sizer | 166/125 |
| 3,183,972 | 5/1965 | Fredd . | |
| 3,215,208 | 11/1965 | Tamplen | 166/198 |
| 3,227,462 | 1/1966 | Tamplen | 277/34 |
| 3,273,649 | 9/1966 | Tamplen . | |
| 3,278,192 | 10/1966 | Tamplen . | |
| 3,452,777 | 7/1969 | Dollison . | |
| 3,664,427 | 5/1972 | Deaton | 166/313 |
| 3,912,009 | 10/1975 | Davis, Jr. | 285/360 X |
| 4,252,143 | 2/1981 | Fredd | 137/115 |
| 4,252,195 | 2/1981 | Fredd | 166/133 X |
| 4,274,485 | 6/1981 | Fredd | 166/250 |
| 4,321,965 | 3/1982 | Restarick et al. | 166/117.5 |
| 4,391,326 | 7/1983 | Greenlee | 166/240 |
| 4,407,362 | 10/1983 | Bechthold | 166/117.5 |
| 4,583,592 | 4/1986 | Gazda et al. | 166/250 |
| 4,625,799 | 12/1986 | McCormick et al. | 166/223 |
| 4,664,187 | 5/1987 | Weinberg | 166/217 X |

*Primary Examiner*—Stephen J. Novosad
*Assistant Examiner*—William P. Neuder
*Attorney, Agent, or Firm*—Albert W. Carroll

[57] ABSTRACT

A device for releasably connecting well tools together for disconnection thereof downhole in a well without jarring but in response to a series of upward pulls on the cable or flexible line by which the well tools are lowered into the well.

19 Claims, 3 Drawing Sheets

DEVICE FOR RELEASABLY CONNECTING WELL TOOLS

BACKGROUND OF THE INVENTION

1. Field of the Invention

This invention relates to well tools and more particularly to connectors for releasably connecting well tools together for performing downhole operations in wells, especially operations in which delicate instruments, or the like, are used and cannot be subjected to jarring impacts.

2. Description of the Related Art

It is well known to run well tools into wells on a flexible line to perform various downhole operations. Some operations require the use of electrically powered tools, and these tools are run into the well on an electrical conductor cable, electrical energy then being supplied to the downhole tool via the cable from a source of electrical energy on the surface.

Many downhole operations require the use of costly electrical powered instruments, such as electronic pressure transducers, electronic temperature transducers, or the like delicate instruments, either alone or in conjunction with other rather indelicate electrically powered downhole well tools.

Many downhole tools require jarring action in order to accomplish their function, but delicate and expensive instruments such as the aforementioned electronic pressure and/or temperature transducers, for instance, can be readily and severely damaged even by light jarring impacts. Such damage is costly in time, delay, and money, and may even render the downhole operation a complete failure.

Where such delicate instruments are to be used downhole in a well in conjunction with other well tools, especially where jarring will be necessary or likely, the operation of which would be hazardous to such delicate instruments, it is desirable to connect such delicate instruments to the other well tools with a releasable connector device which can withstand a straight upward pull of a predetermined value but which can be released by a straight upward pull of a predetermined lower value and without jarring the delicate electronic instruments. Such connector would make it possible to release the delicate instruments from the other well tools and withdraw them from the well, after which the cable (electrical cable, or non-conductor cable) would be run into the well and latched to the tools left downhole to allow further operations to be performed, including jarring, while the delicate instruments remain safe on the surface.

Connecting devices have generally been of the shear pin type or the spring-loaded type, either of which release in response to a straight upward pull of predetermined value. Some shear pin type connectors are designed to release upon shearing of the shear pin by jarring impacts.

The applicant is familiar with the following prior U.S. patents which disclose structures which may relate to the present invention. These prior patents are:

| | | | |
|---|---|---|---|
| 2,698,056 | 3,215,208 | 3,452,777 | 4,321,965 |
| 2,884,071 | 3,227,462 | 3,664,427 | 4,407,362 |
| 3,100,533 | 3,273,649 | 4,252,143 | 4,583,592 |
| 3,102,593 | 3,278,192 | 4,252,195 | 4,625,799 |

-continued

| | | |
|---|---|---|
| 3,183,972 | 3,395,728 | 4,274,485 |

U.S. Pat. No. 2,884,071 which issued Apr. 28, 1959 to John V. Fredd shows a running tool releasably connected to the upper end of a well tubing plug by a simple and well-known shear pin. The shear pin is to be sheared by upward jarring impacts, but could be sheared by a straight upward pull of predetermined value.

U.S. Pat. No. 2,698,056 which issued to Samuel J. E. Marshall on Dec. 28, 1954 shows a running tool releasably connected to a well device with a pair of shearable pins which are disposed tangentially of the shearing surfaces.

U.S. Pat. No. 3,100,533 which issued Aug. 13, 1963 to John V. Fredd shows a running tool releasably connected to an anchoring and sealing device, this connection comprising a prong with an external recess latched into a first sleeve by balls carried in windows of this first sleeve for radial movement, and a second sleeve surrounding the first sleeve and confining the balls to their inner locking position. The prong is released when it is lifted sufficiently to allow the balls to move to an outer position and disengage the prong.

U.S. Pat. No. 3,102,593 which issued to Phillip S. Sizer on Sept. 3, 1963 shows a ball-sleeve connection very similar to that disclosed in U.S. Pat. No. 3,100,533, supra, but also shows lugs being used instead of balls.

U.S. Pat. No. 3,183,972 which issued to John V. Fredd on May 18, 1965 shows a running tool connected to a perforator hanger. This connection is similar to that seen in U.S. Pat. No. 3,100,533, supra, and it shows the running tool just having been freed in FIG. 2A.

Other well-known uses of balls, lugs, and collets are seen in the following patents:

U.S. Pat. No. 3,215,208 to Jack W. Tamplen, issued Nov. 2, 1965

U.S. Pat. No. 3,227,462 to Jack W. Tamplen, issued Jan. 4, 1966

U.S. Pat. No. 3,273,649 to Jack W. Tamplen, issued Sept. 20, 1966

U.S. Pat. No. 3,278,192 to Jack W. Tamplen, issued Oct. 11, 1966

U.S. Pat. No. 3,395,728 to Jack W. Tamplen, issued Aug. 6, 1968

U.S. Pat. No. 4,407,362 to Howard D. Bechthold, issued Oct. 4, 1983

U.S. Pat. No. 4,252,143 to John V. Fredd, issued Feb. 24, 1981

U.S. Pat. No. 4,252,195 to John V. Fredd, issued Feb. 24, 1981

U.S. Pat. No. 4,274,485 to John V. Fredd, issued June 23, 1981.

U.S. Pat. No. 4,321,965 which issued to Henry J. Restarick and John R. Setterberg on Mar. 30, 1982 teaches not only use of a well-known shear pin for emergency disconnect, but is primarily cited because it teaches use of a continuous zig-zag slot in which a pin carried by a rotatable sleeve travels as the slot is forced up and down relative to the pin to thus convert this longitudinal movement into rotational movement.

U.S. Pat. No. 4,625,799 which issued to William H. McCormick and Charles C. Cobb on Dec. 2, 1986 also shows a pin and continuous zig-zag slot arrangement for converting longitudinal movement into rotational movement. Thus, the nozzle section of a well washing apparatus is caused to rotate as a result of being lifted and lowered at the washing area.

U.S. Pat. No. 3,664,427 which issued on May 23, 1972 to Thomas M. Deaton discloses use of a continuous zig-zag control slot in a circulation control valve for use in wells. The control slot is formed in a collar carried on the stem of a valve biased toward its seat by a dome charge of gas. When dome pressure is overcome by external pressure, the valve moves off seat and the pin causes the collar to rotate. When external pressure decreases, the valve is latched open because the pin occupies a short leg of the slot. When pressures are cycled again, the pin reaches a long, open leg slot and the valve is allowed to close.

U.S. Pat. No. 4,583,592 issued to Imre I. Gazda on Apr. 22, 1986 and is cited here for two reasons. First, in the test tool device, as seen in FIG. 2A, a shear pin 272 releasably fastens sleeve 269 in place. Pin 272 can be sheared by an upward force on extension 236. O-ring 267 is placed between the lower end of sleeve 269 and upwardly facing shoulder on extension 236 to absorb shocks and thus prevent inadvertent shearing of pin 272. In actual public use, the connection seen in FIG. 2A was improved by placing additional o-rings above the sleeve so that slight downward jarring would be absorbed in the same way. That same shock absorbing connection is used on the present invention. Second, the device of FIGS. 1–8 is provided with a control slot 354 in which is engaged a control pin 350 carried on a floating (free to rotate) ring 348. As the slot moves up and down, the pin follows the slot and causes the ring to rotate. The control slot, as shown, on every fourth lift will cause lifting of a key release mechanism to unlock the test tool device from its landing receptacle. Otherwise, an upward pull will not release the lock mechanism, although a pull of a predetermined value (higher than the value of the pull otherwise required to unlock the device) will overcome the shear pin 272 and cause a disconnect at that point.

The present invention combines features like or similar to some of those found in the prior patents mentioned hereinabove and allows connecting costly and delicate electric or electronic instruments with other well tools in a tool string for running into a well to perform certain desired downhole operations and to gather certain desired well data, the data generally being gathered and the delicate instruments pulled from the well before jarring operations are commenced. Subsequently, a tool train including a connector device or fishing tool is lowered into the well, reconnected to the well tools left therein and operations continued. The present invention thus makes possible the safe use of delicate instruments in conjunction with other downhole well tools for accomplishing operations which otherwise would be risky, costly, impractical, or impossible.

SUMMARY OF THE INVENTION

The present invention is directed to connectors for releasably connecting well tools together, the connector comprising a tubular housing having means at its lower end for connection with a lower well tool and having an internal release recess above such connection, a prong connectable to an upper well tool and having its lower end received in the housing and having a latch recess above its lower end, latch members slidable longitudinally in the housing and engageable with the recess of the prong to latch the prong in the housing, the latch members being disengageable from said prong upon being moved upward to a level at which the latch members can move outward into the housing recess and release the prong for removal from the housing, means biasing the latch members downward for maintaining them in latched prong engaging position, and control means engageable between the prong and housing for preventing the lifting of the prong and latch members to releasing position until they have first been lifted in the housing a predetermined plurality of times.

It is, therefore, one object of this invention to provide a connector device for use in a well tool string lowerable into a well on a flexible line and being remotely operable in response to a series of upward pulls on the flexible line.

Another object of this invention is to provide a connector device of the character described having a housing connectable to one well tool and a prong connectable to another well tool, the prong being latchingly received in the housing, there being latch members engageable with said prong to releasably retain it in the housing and spring means biasing the latch members toward latching position but liftable by an upward pull on the prong to an upper location wherein said latch members can disengage the prong to free it for removal from the housing.

Another object is to provide such a connector device wherein the latch members are lugs carried in windows of a carrier and the spring means is a coil spring bearing downward upon the upper end of the carrier.

A further object is to provide such a connector providing a control pin on one and a control slot on the other of the prong and housing to limit upward movement of the prong in the housing to avoid releasing the prong from the housing until the prong has been lifted in the housing a predetermined plurality of times.

Another object is to provide such a connector device having the control slot formed as a continuous zig-zag slot having short and long legs and advancing about the connector and the control pin is carried on a ring which is free to rotate as the pin follows the control slot in response to the control slot moving up and down in response to pulling and relaxing the cable.

A further object is to provide a connector device of the character described wherein the prong is formed in two portions which are then releasably attached together with a shearable pin, the shear value of the shear pin being greater than the load required to lift the prong to releasing position in the housing.

Another object is to provide a shock-absorbing material in the shear pin connection to reduce unintentional shock loads applied to the shear pin during lowering of the well tools into the well.

Another object is to provide a connector device of the character described which after being disconnected can be remotely reconnected.

A further object is to provide a connector device of the character described having its control slot flared at the lower ends of its long legs to provide a guide surface for automatically orienting the prong as it enters the housing.

Another object is to provide a connector device of the character described having a lateral passage below the latch means for communicating the interior of the housing with the exterior thereof.

Another object is to provide such a connector device having a porous material in said lateral passage for filtering solids out of well fluids entering the housing therethrough.

Other objects and advantages will become apparent from reading the description which follows and from studying the accompanying drawing, wherein:

DESCRIPTION OF THE PREFERRED EMBODIMENTS

Figure 1A:
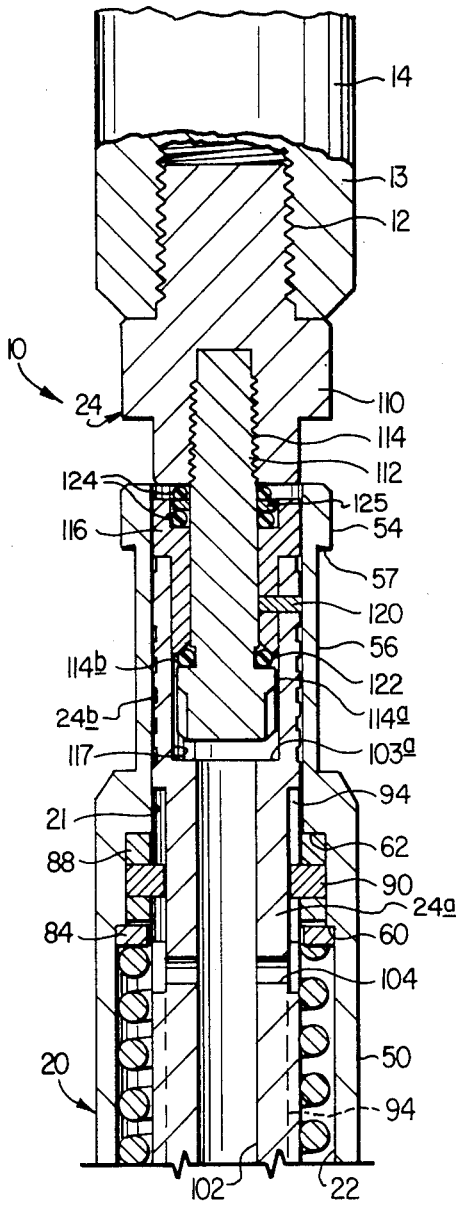
FIGS. 1A and 1B, taken together, constitute a continuous longitudinal sectional view showing a connector device constructed in accordance with the present invention.
Figure 1B:
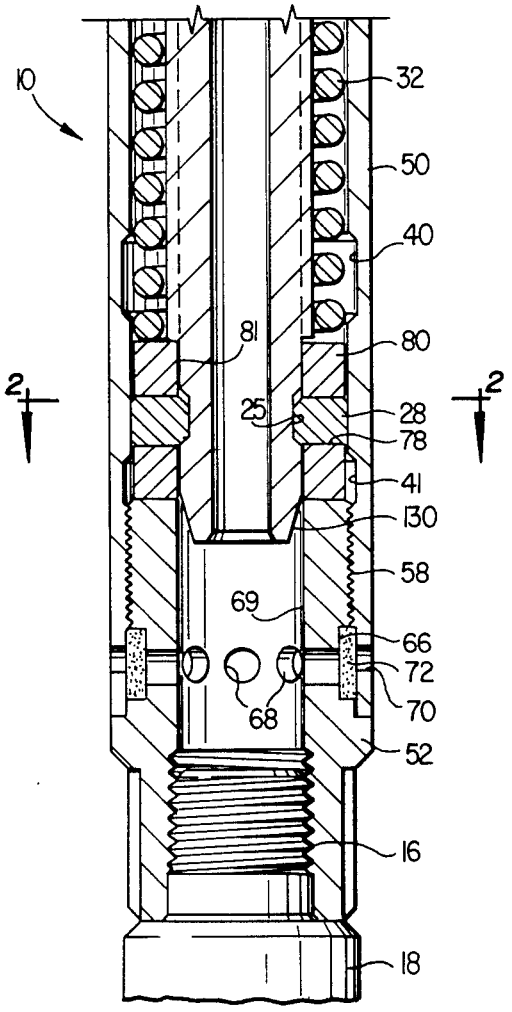

Referring now to FIGS. 1A and 1B, it will be seen that the connector device of the present invention is indicated generally by the numeral 10 and that it is connected as by thread 12 to well tool 13 which forms a part of well tool train 14 and is similarly connected as by thread 16 at its lower end to the upper end of a lower well tool 18. Well tool 18 may support other well tools (not shown) connected to its lower end. Delicate instruments (not shown), such as electronic pressure transducers and/or electronic temperature transducers, for instance, would be included in well tool train 14 above the connector device 10.

The connector device 10 comprises a housing assembly 20 having a bore 21 into the upper end of which a prong assembly 24 is telescoped as shown and is latched therein by latch lugs 28 engaged in the prong's external recess 25 and which are slidable longitudinally in the housing. These latch lugs 28 are biased downwardly in the housing assembly by means such as the spring 32 but can be lifted by the prong by a pull of sufficient force to overcome the force of the spring. It is to be noted that this connection is similar to that taught in U.S. Pat. No. 3,100,533, supra, the principal difference being that lugs are substituted in the place of balls. U.S. Pat. No. 3,100,533 is incorporated herein by reference thereto for all purposes. The connector device 10 thus connects the upper well tool 13 to the lower well tool 18 and will maintain them thus connected so long as the latch lugs 28 remain engaged in the external annular recess 25 near the lower end of the prong assembly 24. Whenever the prong is lifted in the housing to such extent that the latch lugs 28 become aligned with the internal annular recess 40 formed in the inner wall of the housing, the latch lugs will move outwardly thereinto and disengage the prong which may then be readily lifted free of the housing.

Means are provided to prevent the prong from being lifted to such level in the housing until it has been lifted a plurality of times. In the meantime, the prong can only be lifted a short distance and no more. The control means for thus limiting the upward movement of the prong in the housing will be explained later.

The housing assembly 20 is preferably formed in two parts which are then screwed together. Thus, the housing assembly 20 comprises a housing member 50 and a lower sub 52. The housing member 50 is reduced at its upper end as at 54 and is further reduced as at 56 to provide an external annular downwardly facing fishing shoulder 57 which is engageable by a suitable fishing tool (not shown) by which the housing and the tools attached therebelow may be retrieved from the well. At its lower end, the bore 21 of the housing 50 is enlarged as at 22 and is internally threaded as at 58 for attachment of the upper threaded end of the lower sub 52, as shown.

The housing member 50 is provided not only with the internal annular recess 40 as mentioned before but is further provided with stepped downwardly facing internal annular shoulder means near its upper end which provide a first downwardly facing shoulder 60 and a second downwardly facing shoulder 62 spaced thereabove whose purpose will be described later.

Below the external thread 58 on the upper end of the lower sub 52, there is provided an external annular recess 66. In addition, one or more lateral passages such as communication ports 68 are provided in the wall of the lower sub to communicate the bore 69 of the sub with the exterior thereof. The lower portion of the housing member 50 below the thread 58 is similarly provided with lateral passages such as the communication ports 70 which communicate with the flow ports 68 of the lower sub by way of the external annular recess 66. A porous material 72 is carried in the recess 66 so that fluids passing therethrough from the outside will be filtered to preclude sand or detritus from entering the device. The porous material 72 may be any suitable material such as sponge, felt, porous metal, or the like.

Figure 2:
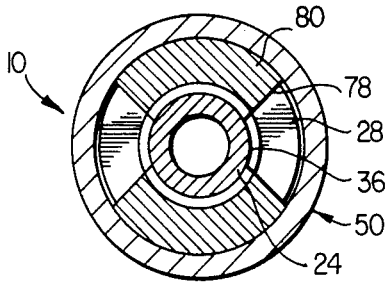
FIG. 2 is a cross-sectional view taken along line 2—2 of FIG. 1B.

As seen in FIGS. 1A, 1B, and 2, the lugs 28 are disposed in windows 78 formed in a carrier 80 which surrounds the prong, as shown, and is slidable longitudinally in the housing member 50. It will be noted that the housing member 50 is shown in FIG. 1B to be formed with an internal annular recess 41 located adjacent the upper end of internal thread 58. This internal recess 41, while not absolutely necessary, is provided as an expedient in assembling the connector device 10. The internal recess 41 will accommodate the latch lugs 28. During assembling of the device, the inner parts, ring 88, worker 84, spring 32, and carrier 80 with its lugs carried in its windows are inserted into the housing member through its lower, internally threaded end. The lower sub 52 is then screwed into the lower end of the housing member 50, but is only screwed in about half way. Now, when the prong 24 is inserted into the housing member from the top, the carrier 80 can move down sufficiently to permit the prong to force the lugs outward into internal recess 41 and allow it to be positioned so that subsequently the lugs can engage the external recess 25 of the prong. The lower sub is then tightened. The lugs are movable radially between inner and outer positions. The windows 78 are tapered as shown in FIG. 2 to limit inward movement of the lugs and preclude them from falling from the windows when the prong is not in place between them. In their inner position (shown), they engage in the external annular recess 25 of the prong. In this position, their outer surface does not project appreciably beyond the periphery of the carrier. The internal wall of the housing member 50 will normally confine the lugs to this inner position. However, when the carrier 80 is moved upwardly, as by being lifted by the prong being pulled upwardly and the lugs 28 reach the internal annular recess 40 in the housing, the lugs move to their outer position in which their inner surfaces do not project into the bore 81 of the cage. The lower side of the prong's external annular recess 25 is inclined so that the upward force applied by the prong to the lugs will cam them outwardly when the lugs reach the internal annular recess 40.

The coil spring 32 has its lower end in contact with the upper end of the carrier 80 as shown. Thus, the spring applies a constant downward bias to the carrier 80 tending to maintain it in its lowermost position, shown. In this position, the carrier is supported by an upwardly facing shoulder in the housing means. In FIG. 2A, this shoulder is seen to be provided by the upper end of the lower sub 52.

The upper end of the spring is supported by the downwardly facing internal annular shoulder means near the upper end of the housing member 50. As shown, the upper end of the spring is supported by a washer 84 which is supported by downwardly facing shoulder 60. Internal annular downwardly facing shoulder 62 is spaced above the downwardly facing shoulder 60 as shown, and a floating control ring 88 having a pair of inwardly projecting control pins 90 is disposed between the downwardly facing shoulder 62 and the downwardly facing shoulder 60. Of course, the control ring rests upon the washer 84. The floating control ring 88 is shorter in longitudinal dimension than the distance between the downwardly facing shoulder 62 and the upper surface of the washer 84. At the same time, the outside diameter of the control ring is slightly smaller than the inside diameter of the housing at that point. The control ring thus is a loose fit in the housing and can rotate freely as required and for a purpose which will be brought to light hereinbelow.

The prong means 24 may be formed in one piece if desired. The prong 24 is not only provided with the external annular recess 25 as previously described but is also provided with control slot means 94 which is engageable by the control pins 90 for limiting upward movement of the prong in the housing in such manner that the prong can be released only after a predetermined plurality of upward pulls. This control slot is shown in the development view of FIG. 3.

Figure 3:
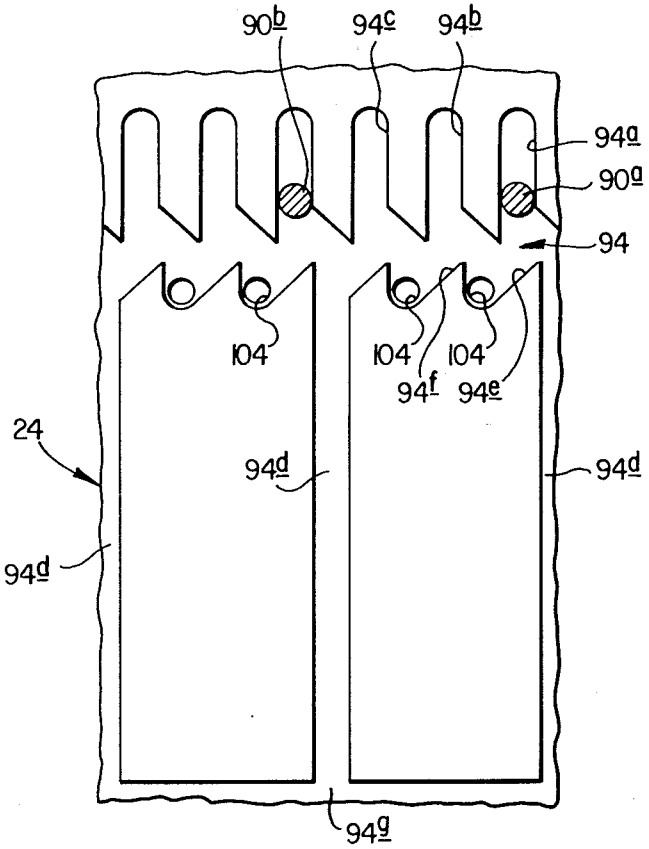
FIG. 3 is a development view showing the control slot and control pin arrangement of the device shown in FIGS. 1A and 1B.

In FIG. 3 it will be seen that the prong means 24 is provided with control slot means 94 and that the control pins 90 are engaged therein. This control slot and pin arrangement is similar to that taught in U.S. Pat. No. 4,583,592, supra. U.S. Pat. No. 4,583,592 is incorporated herein by reference thereto for all purposes. While one control pin 90 might be acceptable, two such pins at 180 degrees apart share and balance the forces involved. In FIG. 3, two pins 90 are shown, and these pins are indicated by reference numerals 90*a* and 90*b* for convenience.

Since the control pins 90*a* and 90*b* do not move longitudinally of the housing, it is understood in FIG. 3 that these control pins do not move up and down. The prong 24 can move longitudinally of the housing. Therefore, in FIG. 3 the control slot 94 is understood to be movable upwardly and downwardly relative to the control pins 90*a* and 90*b* which, being a part of the rotatable floating ring 88, can move horizontally.

When the prong 24 is latched into the housing assembly as is shown in FIGS. 1A and 1B, the control pins 90*a* and 90*b* will occupy a position in control slot means 94 as depicted in FIG. 3. The control slot means 94 is a zig-zag type continuous slot which can be followed by the control pins as the prong on which the control slot is formed is moved up and down relative to the pins. The pins will be caused to advance towards the left as seen in FIG. 3 as this up and down movement of the slot takes place. The control pin 90*a* is seen to occupy an upper leg 94*a* of the control slot means 94. Other upper legs 94*b* and 94*c* are also provided. In a similar manner, lower legs 94*d*, 94*e*, and 94*f* are provided. (Lower legs 94*e* and 94*f* are short, lower leg 94*d* is long.) The upper legs extend upwardly a distance greater than the distance which would seem necessary, however, it is necessary to move the prong downwardly during assembly so that the lugs may be moved outwardly into the internal annular recess 41 in the housing in order to engage the lugs in the external recess 36 of the prong before the bottom sub 52 is screwed fully into the lower threaded end of the housing.

As seen in FIG. 3, if the control slot means 94 is moved upwardly, the pin 90*a* will be engaged by the inclined guide surface of lower leg 94*e*, and the pin will be cammed to the left until it comes to rest at the lowest part of leg 94*e*. In this case, the prong has reached its upper limit for now and cannot be lifted further. At this time, the latch lugs 28 will not have been lifted sufficiently high to engage the internal annular recess 40 of the housing, and the prong cannot be withdrawn therefrom. As the prong is moved back downwardly again, the control slot moves down, and the pin 90*a* engages the inclined guide surface of leg 94*b* and is cammed to the left as it enters the upper leg 94*b* of the control slot. When the prong is lifted again, the control slot will be moved upwardly, the control pin 90*a* will strike the cam surface of lower leg 94*f* of the control slot, and the pin will be cammed to the left and will come to occupy the lowest portion of leg 94*f*. Again the prong has been stopped short of release and can be lifted no further. When the control slot is moved downwardly again, the pin will engage the cam surface at the lower end of leg 94*c* and will be guided into leg 94*c*. The next time that the prong is lifted, the control slot will move upwardly and the cam surface at the upper end of the next lower leg 94*d* will engage the pin and cam it to the left. This time the prong can be lifted high because slot 94*d* is long and opens at its lower end as at 94*g*. In this condition, the prong may be lifted, compressing spring 32 more fully until the lugs 28 are able to engage outwardly in recess 40 of the housing, thus releasing their engagement with external annular recess 25 of the prong, thus releasing the prong for easy withdrawal from the housing.

It will be noticed that the long legs 94*d* of the control slot are 180 degrees apart and that the control pins 90*a* and 90*b* are also 180 degrees apart, thus as one control pin 90 is following the path just described, the other control pin is duplicating that action on the opposite side of the tool.

It is now readily seen that the prong may be disconnected from the housing only after it has been lifted twice a sufficient distance to cause the pin to move through the control slot until it reaches the long, lower leg 94*d*. Thus, in the device illustrated, three pulls are required in order to pull the prong free, provided each pull is sufficient to cause the floating ring 88 to turn as just described.

The control slot could possibly be formed with additional upper and lower legs so that there would be a greater number of legs for each long, open-ended leg such as leg 94*d*. In this way, the prong would need to be lifted a greater number of times before being released. On the other hand, the control slot 94 could be formed with every other lower leg long in which case the prong would release on every second pull.

It may be desirable to form the prong 24 in upper and lower sections and then attach these two sections together with a shear pin connection like or similar to that taught in U.S. Pat. No. 2,884,071, mentioned hereinabove. Then should the tool become fouled downhole, a pull could be applied to the tool string 14 with sufficient force to cause shearing of the pin to thus make it possible to retrieve the tool string with the upper portion of the prong. If the prong is to be formed of two sections, it may be desirable to fashion the lower section 24*a* thereof with a central bore 102 enlarged as at 103 for insertion of the upper section after which a shear pin would be used to hold the two sections together. If the lower section is formed with the central bore 102, it is preferable to provide lateral openings such as lateral openings 104 which are located in the lower short legs of the control slot 94 as seen in FIG. 3. These openings 104 provide a way of escape for sand or other solids which might otherwise hinder the progress of control pin 90 through the course of control slot 94. Of course, a simple shear pin connection such as that just described may be satisfactory in many cases, but in other cases, it may be preferable to provide some means of absorbing shock to avoid undue stresses on the shear pin during running and pulling of the well tool string. Such a structure is shown in FIG. 1A and will now be described.

The upper portion of the prong assembly 24 includes an upper sub 110, a pull rod 112 threadedly attached thereto as at 114 and having a head 114*a* providing an upwardly facing shoulder or upper side 114*b* , and a shear sleeve such as shear sleeve 116 which surrounds the pull rod 112. Shear sleeve 116 has its lower portion reduced in outside diameter and is telescoped into the enlarged bore 117 at the upper end of the lower prong section where it is releasably held by one or more shear pins such as the shear pin 120. The quantity, diameter, and material for these shear pins 120 may be selected to provide the shear value desired.

An o-ring 122 is disposed between the lower end of the shear sleeve 116 and the upper side 114*b* of the pull rod head 114*a*. If desired, the lower inside corner of the shear sleeve may be suitably chamfered so that when the pull rod is lifted, the o-ring 122 will be squeezed without being unduly damaged. In similar manner, one or more o-rings may be placed between the lower end of the upper sub 110 and the upper end of the shear sleeve. In the device shown in FIG. 1A, the shear sleeve 116 is counterbored to provide space for two o-rings 124 with a spacer ring 125 therebetween. In this manner, when the tools are being lowered into the well, and for some reason the upper sub applies a downward force to the lower portion of the prong, the two upper o-rings 124 will be compressed as they tend to absorb this downwardly applied force. On the other hand, when the pull rod is for some reason caused to apply an upward force to the shear sleeve, the lower o-ring 122 will be compressed and will tend to absorb this shock. It will be noticed that the lower end of the pull rod does not strike the upwardly facing shoulder 103*a* at the lower end of the enlarged bore 103 of the prong.

The connector device 10 of FIGS. 1A–3 has its lower prong section 24*a* formed with a plurality of spaced apart external annular grooves such as grooves 24*b* near its upper end and above its control slot 94, as seen in FIG. 1A, for the purpose of trapping sand particles or other detritis which may enter the device through the upper end of the housing member 50, to thus prevent fouling of the prong means in the housing member.

When it becomes necessary to disconnect the well tool string 14 from the lower well tool 18, which at this time is anchored in the well and may already have been used in performing certain downhole well operations, an upward pull is applied to the pull rod to lift the prong relative to the housing and cause the control pin to follow the control slot in the manner described previously until such time as the prong is lifted to such extent that the lugs 28 may move out into the internal annular recess 40 of the housing and disengage the prong for removal from the device.

Should it be impossible to operate the control slot mechanism in order to effect a disconnect, it would be necessary to shear the pin 120 by applying an upward force to the well tool string 14. Afterwards, a fishing tool (not shown) may be run into the well on a tool string to engage the upper end of the housing assembly, gripping the fishing neck at the upper end thereof with dogs (not shown) which will engage the downwardly facing shoulder 57 so that operations may be continued with the well tools below connector device 10, and may be jarred as a part of their operation or retrieval.

The device 10 just described with respect to FIGS. 1A, 1B, 2 and 3 is useful in running a tool string such as well tool string 14 on an electric cable, which tool string would include delicate instruments such as bottom hole pressure gages or transducers and bottom hole temperature instruments, or the like. Such instruments are delicate and cannot be jarred even slightly without risk of doing great damage thereto. Thus, in case the well tool string becomes fouled downhole rather than using jarring impacts to free them or to make a disconnect, the device 10 is operated in the manner described above to make the disconnect through use of a plurality of simple upward pulls on the electric cable.

The pulling force required to release the prong means from the housing means depends upon the strength of spring 32, its preload, and the distance which the lugs 28 must be lifted to the release point. If the preload of spring 32 is 160 pounds, its rate 180 pounds per inch, and the distance the lugs are to be lifted is 0.8 inch, then, the spring load at release will be 160 pounds plus the product of 0.8 times 180 pounds. This equals 160 plus 144, or 304 pounds.

It is understood that when the prong is released as just described and is withdrawn from the housing means, the spring 32 will force the carrier 80 to its lowermost position shown in FIG. 1B, in which position it rests atop the upper end of the lower sub 52. In this position, the lugs 28 are not in alignment with the internal annular release recess 40 and therefore they project inwardly of the carrier so that it would be impossible to re-engage the prong with the housing means were it inserted therein again. The lower end of the prong being tapered as at 130 will tend to cam the lugs 28 outwardly, but this cannot be accomplished since the housing means confines the lugs to the position shown in FIG. 1B.

If desired, a device similar to the device 10 shown in FIGS. 1A and 1B may be provided for operations wherein it would be desirable to relatch the prong into the housing means. Such modified device is illustrated in FIGS. 4A and 4B.

Figure 4A:
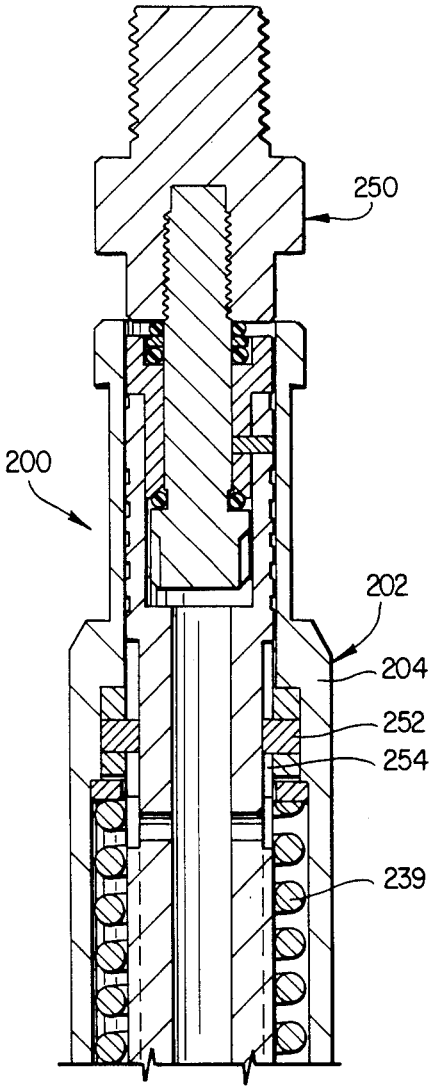
FIGS. 4A and 4B, taken together, constitute a continuous longitudinal sectional view similar to that of FIGS. 1A and 1B but showing a modified form of connector device embodying the present invention.
Figure 4B:
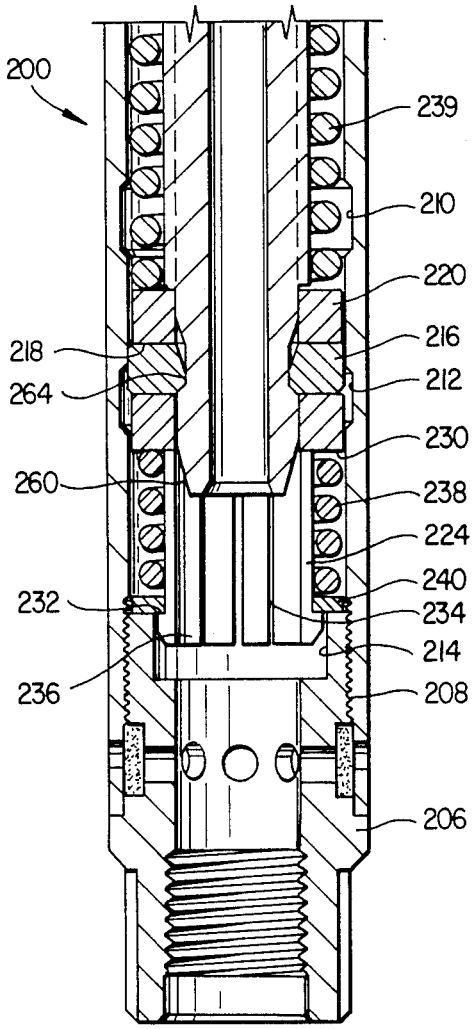

Referring now to FIGS. 4A and 4B, it will be seen that the device of this invention is indicated generally by the reference numeral 200 and that its structure is very similar to the first embodiment illustrated in FIGS. 1A–3, the differences having to do with features which permit relatching of the prong into the housing.

The housing means 202 of the device 200 comprises a housing member 204 and lower sub 206 connected together as by a thread as at 208. The housing member 204 is very similar to the housing member 50 with the exception that it is slightly longer and has not only an internal annular recess 210 which is equivalent of the internal annular recess 40 of the first embodiment, but it also has a second internal annular recess 212 spaced therebelow, as shown, to permit relatching of the prong with the housing. Thus the housing is provided with upper and lower recesses 210 and 212, respectively.

The lower sub 206 of the device 200 differs from the lower sub 52 of the previous embodiment 10 only in that it is provided with a counterbore 214 at its upper end as shown.

The latch lugs 216 are carried in suitable windows 218 of the carrier 220 to perform the latching and unlatching functions as described previously with respect to the first embodiment. However, the carrier 220 differs from the carrier 80 of the previous embodiment in that it is provided with a downwardly directed extension 224 which is reduced in diameter to provide a downwardly facing shoulder 230 and an upwardly facing 232 for a purpose soon to be explained. The carrier extension 224 could be made as a separate piece attached to the carrier as by a thread, but formed as shown is provided with a plurality of downwardly opening slots 234 providing a plurality of collet fingers 236. A coiled spring 238 is placed about these fingers so that the upper end of the spring bears upwardly against the downwardly facing shoulder 230 of the carrier. The spring 238 is compressed and a washer 240 is placed against the lower end of the spring and is allowed to come to rest against the upwardly facing shoulder 232 of the extension 224. The washer normally is in contact with the upper end of the lower sub 206 as shown. In order to place the spring and the washer about the extension, it is necessary of course to flex the collet fingers 236 inwardly at the lower ends since the lower end of the extension is greater in diameter than the inside diameter of the spring and of the washer 240.

The spring 238 should have a suitable preload. Normally, this preload should be about 140 to 180 pounds for many operations. Some operations may require a greater preload, and some may require a lesser preload.

The carrier 220 is biased downwardly by coil spring 239 in the same manner that carrier 80 of the previous embodiment is biased downwardly by coil spring 32. The preload of the springs 238 and 239 is to prevent the prong and latch members from moving up and down too easily in the housing, which they might otherwise do on the trip into the well. Such unnecessary movement must be minimized to avoid unintentional release of the connector device. An inadvertent disconnect could be disastrous. The amount of this preload is greatly influenced by the weight of the tools suspended from the connector device.

It is readily understood that since the spring 238 is captured between the oppositely facing shoulders 230 and 232 of the extension, the spring 238, the washer 240, and the carrier with its extension, all travel together as a package. However, when the washer 240 is in contact with the upper end of the lower sub as is shown in FIG. 4B, the carrier can be moved downwardly, but only by compressing the spring 238 further. The counterbore 214 of the lower sub 206 accommodates the collet fingers as they project below the washer 240. When this downward force is removed, the spring 238 will expand and move the carrier back up to the position shown in the drawing.

It is noticed that when the carrier is in its normal position as shown in FIGS. 4A and 4B, the washer 240 is in contact with the upper end of the lower sub. Also, the upper spring is bearing downwardly upon the upper end of the carrier, in which case the latch lugs 216 are at a level just above the housing recess 212. The prong 250 may be lifted in the same way that the prong 24 is lifted in the previous embodiment, and when so lifted, the prong will lift lugs 216 forcing the carrier 220 upwardly in the housing. When this has been done a predetermined plurality of times, with sufficient stroke to cause the control pin 252 (say **252*a* in FIG. 5) to follow the control slot means 254 (in the same manner that control pin 90 followed control slot 94 in the connector 10), the control pin will reach and enter the long open leg 254*d* of the control slot means. When the control pin is in the long leg of the control slot, the prong can be lifted sufficiently high for the lugs 216 to enter the housing recess 210 and at the same time release their engagement with the prong recess 264. The prong, being released, may be withdrawn from the housing to effect the disconnect. When the prong is so lifted, the spring 238 and washer 240 are also lifted by engagement of the upwardly facing shoulder 232 at the lower end of the collet fingers 236** which depend from the carrier. After the prong has been withdrawn from the housing, it may be withdrawn from the well or it may be reinserted and relatched into the housing.

It should be noted that when the prong is removed, the carrier 220 will return to the position shown in FIG. 4B since it is captured between upper and lower springs 239 and 238, which apply equal forces to the carrier. The washer 240 will rest atop the lower sub 206.

To relatch the prong means 250 in the housing means 202, it must be inserted and a certain amount of weight applied thereto sufficient to force the lower end of the prong into latching engagement. As the prong is pressed downwardly, its tapered surface 260 on its lower end engages the lugs 216 and forces them downwardly while biasing them radially outward, thus also forcing the carrier 220 downwardly, and compressing spring 238 since the lower end of the spring 238 is supported on the washer 240 resting on top of the lower sub 206. The spring 238 must be compressed only a short distance until the lugs 216 can be cammed outwardly into the housing recess 212 to permit the prong to move deeper into the carrier. When the prong recess 264 comes into alignment with the lugs 216, the lugs will move inwardly into engagement with the prong recess 264. When the load applied to the prong is reduced, the spring 238 will expand to lift the lugs to a location above the relatching recess 212 as shown. Thus, the lugs are forced to their inner position of engagement with the prong's recess 264 to latch the prong in the housing means 202.

Figure 5:
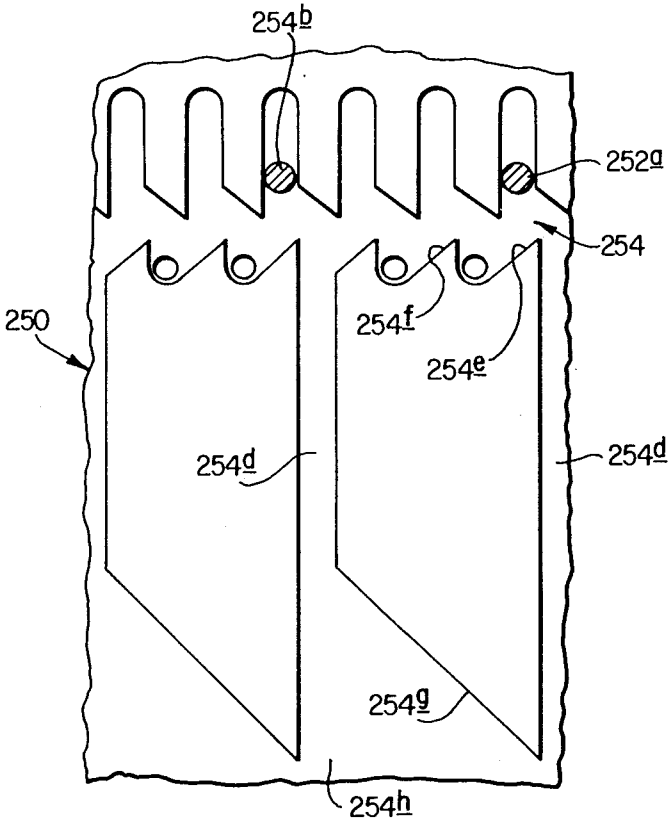
FIG. 5 is a development view similar to that of FIG. 3 but showing the control slot and control pin arrangement of the device of FIGS. 4A and 4B.

It is understood, of course, that in relatching the prong to the housing, each control pin 252 must enter the lower end of a long leg **254*d* of the control slot means 254 (see FIG. 5). This, then, requires that the prong be oriented with respect to the housing. To cause this orientation to occur automatically, the lower end of each long leg 254***d* of the slot means is flared to guide the control pins thereinto as the prong is inserted into the housing. This flaring may be simply provided by forming an inclined guide surface such as guide surface 254*g* as shown to enlarge or flare the slot entrance as at 254*h* to a maximum.

Relatching of the prong 250 in the housing 202 does not require a great downward force. For instance, if the upper and lower springs 239 and 238, as seen in FIGS. 4A and 4B, are preloaded to 160 pounds, then each of them presses against the carrier 220 with a force of 160 pounds.

Suppose that the carrier must move down one-fourth inch (0.25") to engage housing recess 212 and the lower spring 238 must be compressed one-fourth inch to permit relatching of the prong. Suppose also that the rate of lower spring 238 is 150 pounds per inch. Then, 0.25 times 150 equals 37.5 pounds. Thus, the load of spring 238 is increased from 160 to 197.5 pounds.

At the same time, the upper spring is allowed to expand one-fourth inch. If its rate is 180 pounds per inch, then 0.25 times 180 equals 45 pounds. Thus, its load is decreased from 160 to 115 pounds.

Since the load of the upper spring is 115 pounds at relatching, and the load of the lower spring is 197.5 pounds, only 82.5 pounds of weight will be required (197.5 minus 115 equals 82.5) to effect relatching of the prong.

The upward load required to lift the carrier 220 from its position shown in FIG. 4B to its release point wherein the lugs 216 can move out into housing recess 210 and release the prong may be determined as follows:

Assume that the carrier must be lifted 0.8 inch from the position shown in FIG. 4B in order to effect release of the prong. Then, the load increase on upper spring 239 at release will be 0.8 times 180 equals 144 pounds. Thus, the load of the upper spring increases from 160 to 304 (160 plus 144).

It should be understood that the relatchable connector devices 10 and 200, while shown as having an external fishing neck, could as well be provided with an internal fishing neck on the upper end of their housing means if desired. In fact, the internal fishing neck may be preferred, at least in the case of the relatchable form of FIGS. 4A–5. The internal fishing neck has a large inside diameter which would be easier to enter with the prong and would permit forming the lower end of the prong means with say a 45 degree or 60 degree chamfer rather than the 15 degree chamfer shown in the drawing. This would render it less difficult to force the carrier down for relatching the prong in the housing since the chamfer on the end of the prong would tend to expand the lugs outward with much lesser force.

Thus, it has been shown that a novel connector device has been provided which is useful for releasably connecting well tools together and which can be released downhole in a well in response to a series of upward pulls on the cable or flexible line on which the well tools are lowered into the well. It has been shown that the disclosed connector devices fulfill the objects of the invention which were set forth early in this application.

It is further understood that the foregoing description and the drawings are explanatory and illustrative only, and that various changes in sizes, shapes, and arrangement of parts, as well as certain details of their construction, may be made within the scope of the appended claims without departing from the true spirit of the invention.

I claim:

1. A connector device for releasably connecting well tools together, comprising:

(a) tubular housing means having means at its lower end for attachment of a lower well tool and having a first internal annular intermediate its ends and spaced apart first and second downwardly facing shoulders above said internal annular recess;

(b) prong means having means at its upper end for attachment of an upper well tool and having an external annular recess above its lower end, said prong means being telescoped into said housing means for longitudinal movement relative thereto, said prong recess being below said housing recess when said prong means is disposed in said housing means;

(c) latch means for latching said prong means in said housing means, said latch means comprising:

(i) annular carrier means surrounding said prong means and slidable in said housing means and having at least one window through its lateral wall, and (ii) a latching lug carried in each said at least one window and movable radially therein between an inner position of engagement in said prong recess and an outer position of engagement in said housing recess;

(d) spring means in said housing means surrounding said prong means and having its upper end supported against a washer engaged with said first downwardly facing shoulder and having its lower end engaged with said annular carrier means and applying a downward force thereto, said washer and said second downwardly facing shoulder in said housing means forming a second internal annular recess therebetween in said housing means above said spring means; and (e) control means on said prong means and in said housing means conengageable for limiting upward movement of said prong means in said housing means between lower, intermediate, and upper, releasing positions, permitting said prong means to be lifted to its upper, release position therein only after it has first been lifted to its intermediate position a plurality of times, said control means including:

(i) continuous zig-zag control slot means formed in the surface of said prong means, said control slot being formed with short and long legs, there being a plurality of short legs for each long leg, and (ii) a control ring mounted in said second annular recess in said housing means for free rotational movement, said control ring being formed with at least one control pin projecting radially inwardly and engaged in said control slot in said prong means, said control pin advancing along said control slot in response to longitudinal movement of said prong means relative to said housing means, said prong means being released from said housing means only when said control pin occupies a long leg of said control slot and said prong is lifted to its upper, release position wherein said latching lug can move from said prong recess to said housing recess, permitting the prong means to be pulled free of said housing means.

2. The connector device of claim 1, wherein a plurality of external annular grooves is formed in the exterior surface of said prong means at a location close to but above said control slot for trapping sand particles or other detritus to prevent their fouling of the prong means in the housing means.

3. The connector means of claim 2, wherein said prong means is formed in two sections which are then connected together by shearable means which can be sheared should the well tool become fouled, thus to enable the well tools thereabove to be retrieved.

4. The connector device of claim 3, wherein (a) the lower section of said prong means is formed with an upwardly opening bore, (b) the upper section of said prong means is formed with its lower end portion reduced in outside diameter for telescopic engagement in said bore of said lower section of said prong means, said reduced lower end portion of said upper prong section being formed with an external annular recess, (c) an annular shear sleeve is disposed in said recess for limited longitudinal sliding movement therein, (d) resilient ring means disposed in said annular recess above and below said annular shear sleeve, and (e) said shearable pin secures said shear sleeve to said lower section of said prong means by having its opposite ends disposed in aligned apertures in said shear sleeve and said lower prong section, whereby said resilient ring means will absorb unwanted shock forces and prevent premature shearing of said shearable means.

5. The connector device of claim 4, wherein said housing means is provided with an upwardly facing support shoulder below its internal annular recess to limit downward movement of said carrier.

6. The connector device of claim 5, wherein said housing means includes a housing member to the lower end of which a lower sub is attached, the upper end of said lower sub forming the support shoulder for limiting downward movement of said carrier.

7. The connector device of claim 1, 2, 3, 4, 5, or 6, wherein said housing means is provided with lateral opening means comprising at least one laterla opening in its wall below said latch means to provide fluid communication between the interior of the housing means and the exterior thereof.

8. The connector device of claim 7, wherein said lateral opening means in said housing means is bridged by a porous material for filteirng out solid particles carried by fluids entering said housing means through said lateral opening.

9. A connector device for releasably connecting well tools together, comprising:

(a) tubular housing means having means at its lower end for attachment of a lower well tool, said tubular housing means further including:

(i) upper and lower internal annular recesses intermediate its ends, (ii) downwardly facing shoulder means above said recesses, and (iii) an upwardly facing support shoulder below said recesses;

(b) prong means having means at its upper end for attachment of an upper well tool and an external annular recess above its lower end, the lower portion of said prong means being telescopically received in the upper open end of said housing means for longitudinal movement relative thereto, said prong recess being between said upper and lower recess of said housing means when said prong means is disposed in said housing means;

(c) latch means slidably mounted in said housing means and including one or more latch members engageable in said recess of said prong means for latching said prong means to said housing means, said latch means including:

(i) a carrier surrounding said prong means and slidable longitudinally relative to said housing means, said carrier having one or more windows formed therein, said carrier also having a depending extension providing upwardly and downwardly facing stop shoulders, (ii) one or more lugs carried in said one or more windows for radial movement between inner latching and outer releasing positions, (iii) a washer surrounding said extension on said carrier means and supported on said upwardly facing shoulder, said washer extending outwardly beyond said upwardly facing shoulder of said extension for engagement with said upwardly facing support shoulder in said housing means, and (iv) a spring surrounding said extension of said carrier means and biasing said washer downward against said upwardly facing shoulder with a predetermined preload to thus bias said latch means upward toward a position above said lower recess in said housing means;

(d) means in said housing means biasing said latch means downward toward a position below said upper recess in said housing, said biasing means being confined between said carrier and said downwardly facing shoulder means in said housing means; and (e) control means having means on said prong means and said housing means coengageable for controlling movement of said prong means in said housing between lower, intermediate, and upper, releasing positions for preventing said prong means from being lifted to its upper, releasing position until said prong means has been lifted to its intermediate position in said housing means a predetermined plurality of times.

10. The connector device of claim 9, wherein said prong means has a guide surface at its lower end which is inclined upwardly and outwardly for engaging said one or more lugs upon insertion of the prong means into said housing means to force the same downwardly to said lower internal recess and then cam them outwardly thereinto to permit said prong means to move downwardly relative to said one or more lugs until the same can subsequently move inwardly into engagement with said external recess of said prong means to latch the prong means in engagement with the housing means.

11. The connector device of claim 10, wherein said means biasing said latch means is a coil spring.

12. The connector device of claim 11, wherein said control means includes: continuous zig-zag control slot means formed in the surface of one and a control pin carried by the other of said prong means and said housing means, said zig-zag slot means being formed with short and long legs, and having a plurality of short legs for each long leg, said control pin advancing along said control slot in response to longitudinal movement of said prong means relative to said housing means, said prong means being released from latching engagement with said housing means only when said control pin occupies one of said long legs of said control slot to permit said latch means to be lifted to said upper internal recess in said housing means.

13. The connector device of claim 12, wherein said long leg of said zig-zag slot has its lower end flared to provide a guide surface for guiding said control pin into the lower end of said long leg as said prong means is inserted into said housing means.

14. The connector device of claim 13, wherein said downwardly facing shoulder means includes two spaced-apart shoulders, the first of said two shoulders supports the upper end of said spring, and a washer is disposed between the upper end of said spring and said shoulder, and the second of said two shoulders is spaced above said washer to provide an internal annular recess therebetween, and said control pin is carried on a ring loosely disposed in said recess for easy rotational movement about said prong means to permit said control pin to follow said control slot as said prong means is moved longitudinally relative to said housing means.

15. The connector device of claim 14, wherein a plurality of external annular grooves are formed in the exterior surface of said prong means at a location close to but above said control slot for trapping sand particles or other detritus to prevent their fouling of the prong means in the housing means.

16. The connector means of claim 15, wherein said prong means is formed in two sections which are then connected together by shearable means which can be sheared should the well tool become fouled, thus to enable the well tools thereabove to be retrieved.

17. The connector device of claim 16, wherein (a) the lower section of said prong means is formed with an upwardly opening bore, (b) the upper section of said prong means is formed with its lower end portion reduced in outside diameter for telescopic engagement in said bore of said lower section of said prong means, said reduced lower end portion of said upper prong section being formed with an extenral annular recess, (c) an annular shear sleeve is disposed in said recess for limited longitudinal sliding movement therein, (d) resilient ring means disposed in said annular recess above and below said annular shear sleeve, and (e) said shearable pin secures said shear sleeve to said lower section of said prong means by having its opposite ends disposed in aligned apertures in said shear sleeve and said lower prong section, whereby said resilient ring means will absorb unwanted shock force and prevent premature shearing of said shearable means.

18. The connector device of claim 12, 13, 14, 15, 16, or 17, wherein said housing means is provided with lateral opening means comprising at least one lateral opening in its wall below said upwardly facing shoulder to provide fluid communication between the interior of the housing means and the exterior thereof.

19. The connector device of claim 18, wherein said lateral opening means in said housing means is bridged by a porous material for filtering out solid particles carried by fluids entering said housing means through said lateral opening.

* * * * *